United States Patent [19]

Vaccari

[11] Patent Number: 4,719,709

[45] Date of Patent: Jan. 19, 1988

[54] REAR ENTRANCE SKI BOOT

[75] Inventor: Franco Vaccari, Montebelluna, Italy

[73] Assignee: Nordica S.p.A., Montebelluna, Italy

[21] Appl. No.: 26,247

[22] Filed: Mar. 16, 1987

Related U.S. Application Data

[63] Continuation of Ser. No. 840,339, Mar. 17, 1986, abandoned.

[30] Foreign Application Priority Data

Mar. 22, 1985 [IT] Italy ..... 20014 A/85

[51] Int. Cl.[4] ..... A43B 5/04; A43C 11/00

[52] U.S. Cl. ..... 36/117; 36/50; 36/119

[58] Field of Search ..... 36/117–121, 36/50, 89, 92; 24/68 SK

[56] References Cited

U.S. PATENT DOCUMENTS

| | | | |
|---|---|---|---|
| 3,713,231 | 1/1973 | Mochizuki | 36/121 |
| 3,728,804 | 4/1973 | Mochizuki | 36/121 |
| 4,574,500 | 3/1986 | Aldinio et al. | 36/119 |
| 4,577,421 | 3/1986 | Sartor | 36/119 |
| 4,615,127 | 10/1986 | Delery | 36/117 |
| 4,620,378 | 11/1986 | Sartor | 36/119 |
| 4,620,379 | 11/1986 | Sartor | 36/119 |

FOREIGN PATENT DOCUMENTS

| | | | |
|---|---|---|---|
| 0165525 | 12/1985 | European Pat. Off. | 36/117 |
| 0164625 | 12/1985 | European Pat. Off. | 36/117 |
| 2096248 | 2/1972 | France . | |
| 2100490 | 3/1972 | France . | |
| 2257236 | 8/1975 | France | 36/120 |
| 2564711 | 11/1985 | France | 36/119 |

*Primary Examiner*—James Kee Chi

*Attorney, Agent, or Firm*—Guido Modiano; Albert Josif

[57] ABSTRACT

The rear entrance ski boot comprises a boot shell to which a front quarter and a rear quarter are hinged. Also provided is a closure means for tightening the rear quarter toward the front quarter. The invention is peculiar in that it comprises a rear inner quarter connected to the cited shell and spanning the lateral and heel areas of the foot at the ankle region, the rear inner quarter fitting at least partially within the area bounded by the cited rear quarter, for securing the ankle region.

10 Claims, 5 Drawing Figures

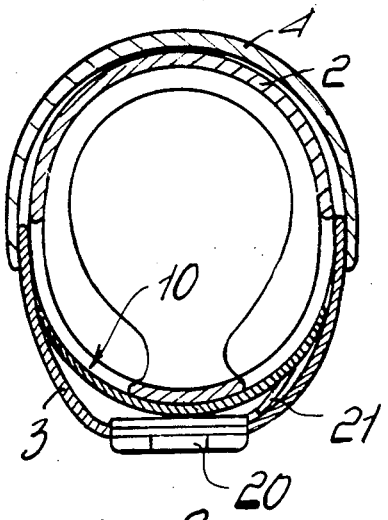
Fig. 3
Fig. 2
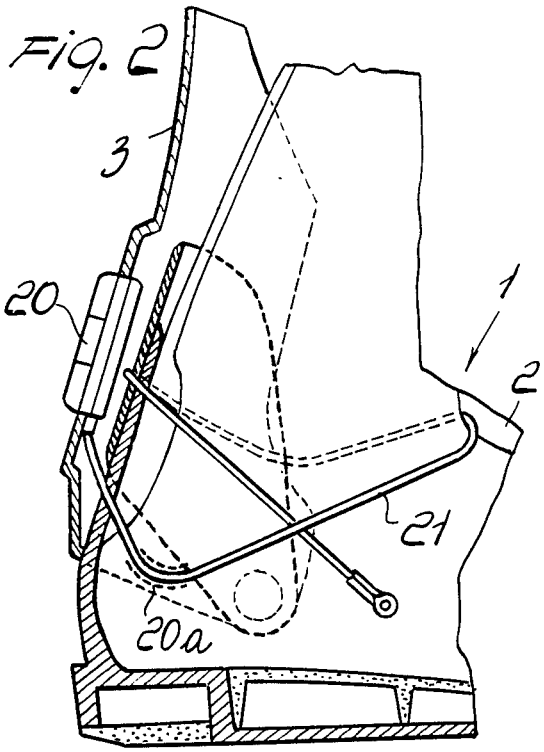
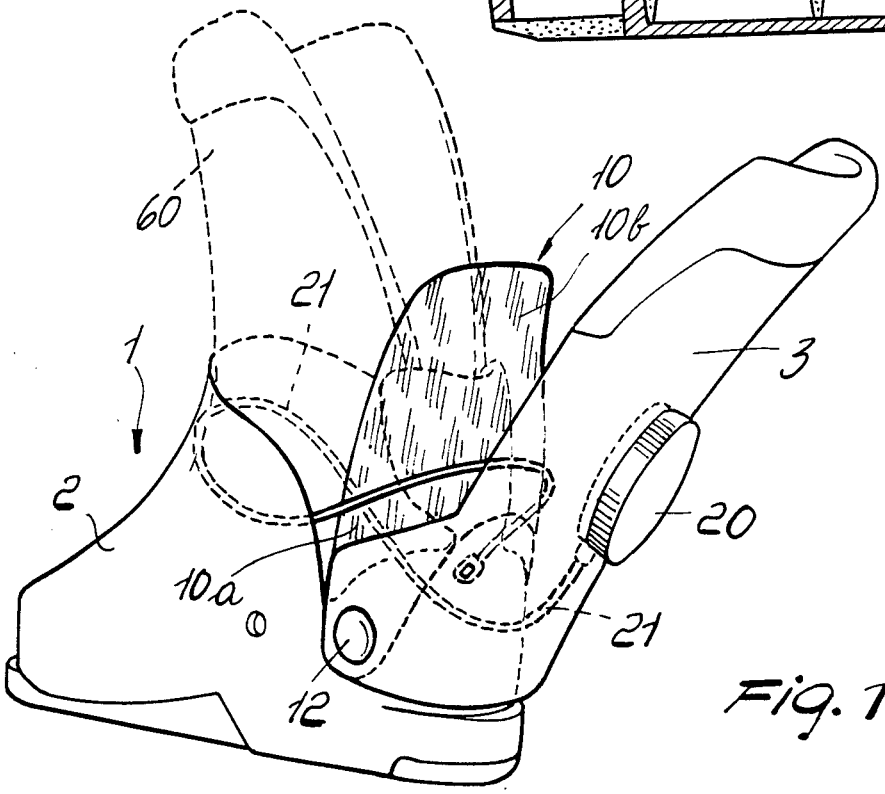
Fig. 1

REAR ENTRANCE SKI BOOT

This is a continuation of Ser. No. 840,339 filed Mar. 17, 1986, now abandoned.

BACKGROUND OF THE INVENTION

This invention relates to a rear entrance ski boot.

As is known, present trends in the construction of rear entrance ski boots have led, for encumbrances considerations, to elimination of the lower closure lever between the front and rear quarters. In fact, the lower portion of the rear quarter is generally required to accommodate vertical levers, foot instep tightening devices, etc. which actually forbid application of the lower closure lever.

The absence of the lower closure lever generally results in a decreased clamping action of the boot at the lateral region of the ankle.

In particular, in flexing the front quarter forward, the flaps of the front quarter and the shell, being no longer held together by the lower lever, tend to move apart and "expand" outwards, with attendant deterioration of the securing action on the region of the ankle, thereby the foot is no longer retained securely.

SUMMARY OF THE INVENTION

It is the aim to which this invention is directed to provide a rear entrance ski boot which, while using no conventional lower lever on the rear quarter, still affords firm securement of the lateral region of the ankle, even as the front quarter is flexed forward.

Within the above aim, it is a particular object of the invention to provide a rear entrance ski boot affording securement all around the periphery of the foot, from the instep to the ankle and, hence, the heel region, thus providing for a more stable and secure retention of the foot.

A further object of the invention is to provide a ski boot which has novel structural features affording improvements over conventional boots.

A not least object of this invention is to provide a ski boot which, while having greatly improved functional characteristics, is structurally simple and easily used by the skier.

The above aim, and these and other objects to become apparent herein below, are achieved by a rear entrance ski boot, according to the invention, comprising a boot shell to which a front quarter and a rear quarter are hinged, a closure means being provided for tightening said rear quarter on said front quarter, characterized in that it comprises a rear inner quarter connected to said shell and spanning the lateral and rear areas of the foot at the ankle region, said rear inner quarter fitting at least partially within the area bound by said rear quarter, thereby securing the ankle region.

BRIEF DESCRIPTION OF THE DRAWINGS

Further features and advantages will become apparent from the following description of some preferred but not exclusive embodiments of a rear entrance ski boot with provisions for securing the ankle region, and the accompanying illustrative but not limitative drawings, where:

FIG. 1 is a perspective view of the boot with the front quarter removed;

FIG. 2 is a cut-away view of the rear portion of the boot;

FIG. 3 is a sectional view taken along the line III—III of FIG. 2;

DESCRIPTION OF THE PREFERRED EMBODIMENT

Figure 5:
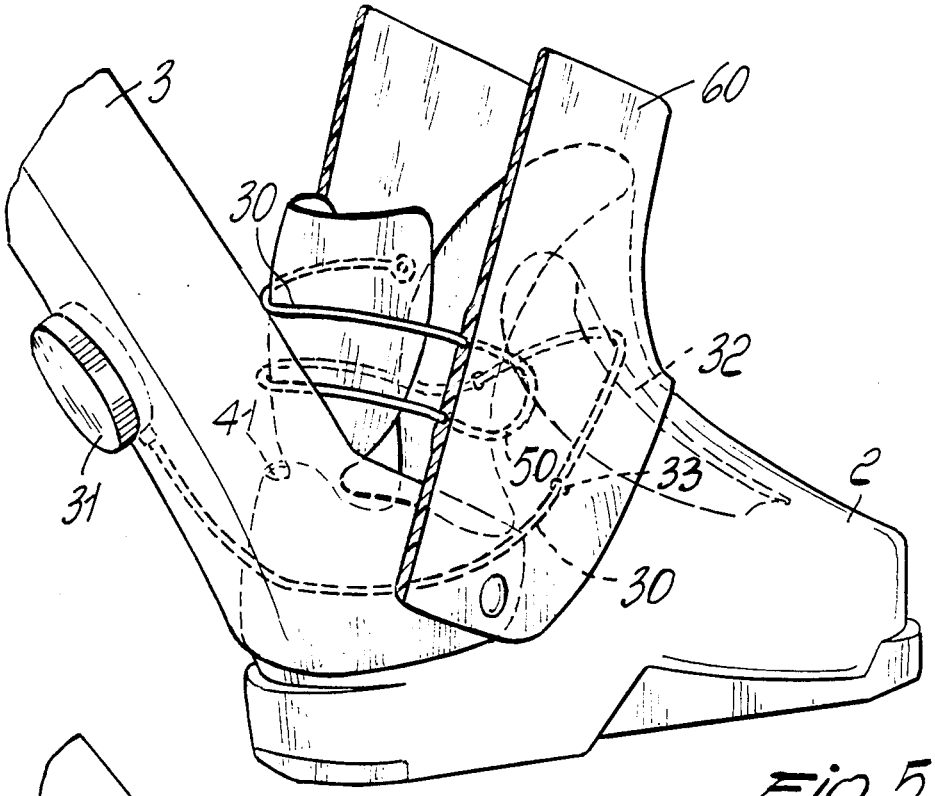
FIG. 5 is a partly cut-away view of a further embodiment.

With reference to the drawing figures, a rear entrance ski boot, defining a location for the wearer's foot and generally indicated by the reference numeral 1, comprises substantially a boot shell 2 to which there are hinged a rear quarter 3 and a front quarter 4 of conventional design and only shown in section in FIG. 3.

The important peculiarity of the invention is that it comprises a rear inner quarter, indicated at 10, which is pivotally connected to the shell 2 about a substantially horizontal pivot axis lying perpendicular to the longitudinal direction of the boot sole.

According to a preferred but not exclusive embodiment, the rear inner quarter 10 is pivoted at the hinge boss or pivot 12 on the rear quarter 3. As best visible in FIG. 2 the rear inner quarter 10 has a lower edge which is more distant from the sole of the boot than the distance of the bottom edge of the rear quarter from said sole, so that the rear inner quarter 10 is entirely covered by the rear quarter 3 in the closed position thereof.

The rear inner quarter has an inwardly facing concave shape defining an inner space to span the lateral and rear areas of the foot, substantially at ankle level.

To this end, the rear inner quarter 10 is provided with side ears **10*a* which extend to the hinge area and upward to become interconnected by a middle portion 10*b*** which is practically located above an area to be left open and unaffected by the rear quarter, thereby the rear quarter can be tilted back opening stage of the boot.

The cited rear inner quarter is formed from a substantially rigid material, and is effective to apply a securing or wrapping action both laterally and rearwardly of the ankle, with the boot in its closed state.

To close the boot, conventional levers may be used which hold the front and rear quarters together, and in this case, the rear inner quarter would provide in practice a shimming member of possibly anatomical shape which, when urged by the rear quarter, moves into locking engagement with the foot and substantially stiffens the side area of the boot.

In a preferred but not exclusive embodiment, a closure means may be utilized, also of conventional construction, which includes a knob 20, located on the rear of the quarter and adapted to take up a cable length 21 which runs laterally inside the shell via a guide **20*a* and then over the area of the foot instep presser to laterally affect said rear inner quarter, it running across the rear thereof and being connected to a fixed point on the opposite side within the shell. Thereby the cable 21, when tightened, presses the inner quarter 10** towards the location of the wearer's foot.

Thus, the cable 21 will apply a tension which also biases the rear quarter sideways, to thus secure the foot all around its periphery and prevent expansion of the boot side areas as the ski boot is flexed forward.

The foot is thus firmly secured along a virtually circumferential region thereof, the securement being unaffected by any flexing of the boot, as is encountered in conventional type boots.

It may be appreciated from the foregoing description that the invention achieves the objects set forth, and in particular it should be emphasized that the additional provision of a rear inner quarter located in the area affected by the rear quarter, and possibly hinged to the same pivot point as the rear quarter itself, affords a sideways constraint action at the skier's ankle level which ensures a constantly stable and reliable securement of the foot within the boot.

The invention herein is susceptible to many modifications and changes within this same inventive concept.

Figure 4:
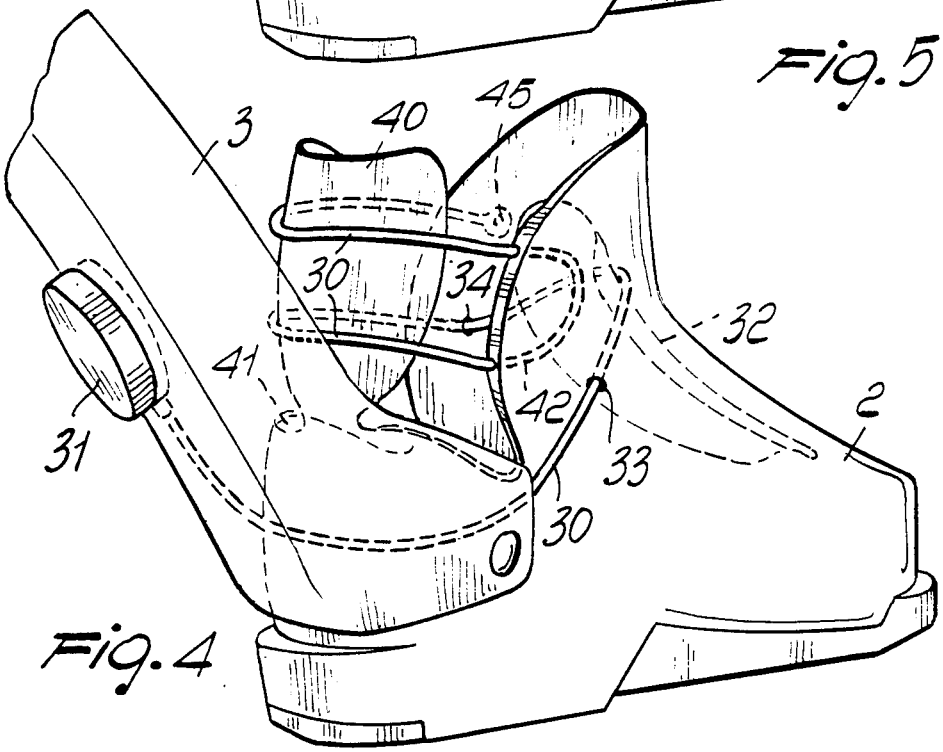
FIG. 4 shows a different embodiment for securement of the ankle region.

Thus, as an example, and as shown in FIG. 4, securement of the ankle may be accomplished to avoid "expansion" of the shell by using a cable length, now designated 30, which would be associated with a take-up reel 31 provided on the rear quarter 3. The cable 30 runs above the area spanned by the foot instep, and specifically over a foot instep presser indicated at 32.

The cable 30 enters, through a throughgoing hole 33, laterally from one side the boot shell 2, engages transversely with the foot instep presser 32, and emerges from the other side of the boot shell 2 through a throughgoing hole indicated at 34.

Here the cable engages with an elongate rear flap or rear inner quarter 40 which extends upwards from the rear edge of the shell 1, and connects to that edge through a necked zone, indicated at 41, which acts in practice as a weakened zone allowing the flap to oscillate relatively to the shell.

The cable 30 extends across the flap 40 and engages with a sliding seat, indicated at 42, which is defined directly by the shell 2, or possibly within a channel insert formed on the shell itself.

The cable 30 then transversely re-engages with the flap 40 at a higher level than the previously described run and has a fixed point at 45 on the remote side portion of the shell from that carrying the sliding seat 42.

In this embodiment, the cable wound around the take-up reel 31, additionally to lowering by its action the foot instep presser and pulling the flap 40 toward the ankle, also acts on the shell edges to compress them sideways, thus completely constraining the ankle.

This kind of an action, consisting of compressing the shell flaps sideways, avoids the boot "expansion" effect, especially as the leg is flexed.

As illustrated in FIG. 5, the cable 30, again connected to the reel 31, runs inside the shell 2 over the presser 32, to then engage transversely with the flap rear 40, and fits within a lay seat 50 provided on the front quarter, designated 60, to then re-engage transversely with the flap 40 and has a fixed point on the side area of the front quarter 60 remote from that defining the lay seat.

Also in this case the lay seat may be formed directly in the thickness of the quarter, or be an insert mounted to the quarter.

In this solution, the cable pulls, during the tightening operation, the front quarter flaps inwards, giving the same result as described above, since a compressive force is again applied from the outside towards the inside on the shell, which will prevent "expansion" thereof.

This solution prevents expansion of the quarter sides both in flexing and bearing rearwardly.

The cable run along the path shown in the drawing figures and as described above is such that it does not interfere with the insertion of the rear quarter 3.

Where the rear quarter does not embrace the front quarter from the outside, then the cable may expediently be adapted to interconnect the two flaps of the front quarter at the very top extremities of the flaps, to improve its effectiveness and to be kept out of sight.

Furthermore, all the details may be replaced with technical equivalents thereof.

In practicing the invention, the materials used, so long as compatible with their specific use, and the dimensions and contingent shapes may be any ones meeting individual requirements.

I claim:

1. In a rear entrance ski boot defining a location for the wearer's foot and including a shell with a sole thereon with a longitudinal extension of the sole and with a plane of lay of the shell, a front quarter member and a rear quarter member hinged to said shell at a hinge point thereof, closure means for tightening said front and said rear quarter members towards each other, said rear quarter member having a bottom edge and a concave shape facing inwards to the ski boot and defining an inner space therein, a rear inner quarter member arranged between said front quarter member and said rear quarter member and hinged to said shell at said hinge point and having a lower edge which is more distant from said sole than the distance of said bottom edge from said sole, said rear inner quarter member having a shape suitable for wrapping at least partially the lateral and rear areas at ankle region of a wearer's foot and being at least partly arranged within said inner space defined by said rear quarter member and wherein said closure means are in the form of cable means encircling at least partially said rear inner quarter member to press it towards the location of the user's foot when said cable means are tightened.

2. A rear entrance ski boot according to claim 1, wherein said rear inner quarter is hinged to said shell for oscillation about a substantially perpendicular axis to the longitudinal extension of the sole of said shell extending parallel to the plane of lay of the shell itself.

3. A rear entrance ski boot according to claim 1, wherein said rear inner quarter is hinged on the hinge point of said rear quarter.

4. A rear entrance ski boot according to claim 1, wherein said rear inner quarter has side ears merging together at a rear area into a joining rear section which overlies a cutout adapted to enable said rear inner quarter to be opened relatively to said shell.

5. A rear entrance ski boot according to claim 1, wherein said rear inner quarter is tightened by means of a pressure action exerted thereon by said rear quarter.

6. A rear entrance ski boot according to claim 1, wherein said closure means comprises a cable associated with a take-up element provided on said rear quarter, said cable running laterally in said shell over the area spanned by the foot instep, said cable encircling said rear inner quarter laterally and rearwardly thereof and being connected to a fixed point inside said shell.

7. A rear entrance ski boot comprising a boot shell having a first side flap with a sliding seat therein and a second opposite side flap, said boot shell having further a free rear edge extending from said first side flap to said second side flap and a rear flap extending from said free rear edge at an intermediate area thereof, said shell defining further an area spanned by a foot instep, a front quarter and a rear quarter hingedly connected thereto, a closure means for tightening said rear quarter against said shell, a take-up element on said rear quarter, a cable associated with said take-up element, said cable being passed above the area spanned by said foot instep, engaging transversely with an outer surface of said rear flap, being passed through said sliding seat defined in the first side flap of said shell, re-engaging transversely with said rear flap and having a fixed point on the second side flap of said shell remote from said first flap defining said sliding seat, thereby securing the ankle region.

8. A ski boot according to claim 7, wherein said rear flap is connected to the free rear edge of said shell with the interposition of a necked section adapted to serve as a pivot point for oscillation of said rear flap with repect to said shell.

9. A rear entrance ski boot comprising a boot shell having a free rear edge and a rear flap extending from said free rear edge at an intermediate area thereof, said shell defining further an area spanned by a foot instep, a front quarter having a first side flap with a lay seat therein and a second opposite side flap, and a rear quarter hingedly connected thereto, a closure means for tightening said rear quarter against said front quarter, a take-up element on said rear quarter, a cable associated with said take-up element, said cable being passed above the area spanned by said foot instep, engaging transversely with an outer surface of said rear flap, passed through said lay seat defined in said first side flap, re-engaging transversely with said rear flap and having a fixed point on the second side flap of said front quarter remote from said first flap defining said lay seat, thereby securing the ankle region.

10. A ski boot according to claim 9, wherein said cable engages with said rear flap along two lines set apart with respect to the longitudinal direction of the ski boot quarter.

* * * * *